US008522967B2

(12) United States Patent
Lindström

(10) Patent No.: US 8,522,967 B2
(45) Date of Patent: Sep. 3, 2013

(54) CELL TRAY

(71) Applicant: K. Hartwall Oy Ab, Söderkulla (FI)

(72) Inventor: Johan Lindström, Söderkulla (FI)

(73) Assignee: K. Hartwall Oy AB, Soderkulla (FI)

( * ) Notice: Subject to any disclaimer, the term of this patent is extended or adjusted under 35 U.S.C. 154(b) by 0 days.

(21) Appl. No.: 13/744,523

(22) Filed: Jan. 18, 2013

(65) Prior Publication Data

US 2013/0199953 A1 Aug. 8, 2013

(30) Foreign Application Priority Data

Feb. 7, 2012 (AU) ..... 2012200699

(51) Int. Cl.
*B65D 25/00* (2006.01)

(52) U.S. Cl.
USPC ..... 206/203; 220/519

(58) Field of Classification Search
USPC ..... 206/139, 203, 427; 220/509, 514, 220/519
See application file for complete search history.

(56) References Cited

U.S. PATENT DOCUMENTS 3,982,654 A * 9/1976 Gottsegen ..... 220/519
5,071,026 A 12/1991 Apps
5,305,884 A * 4/1994 Apps et al. ..... 206/519
5,320,245 A * 6/1994 Apps et al. ..... 220/510
5,826,712 A * 10/1998 Aikio ..... 206/203
5,842,572 A * 12/1998 Apps et al. ..... 206/503
6,279,770 B1 * 8/2001 Osbakk et al. ..... 220/519

FOREIGN PATENT DOCUMENTS

BE 1006197 A3 6/1994
DE 295 00 197 U1 8/1995
GB 2 130 555 A 6/1984
WO WO 2011/083207 A1 7/2011

* cited by examiner

*Primary Examiner* — Jacob K Ackun

(74) *Attorney, Agent, or Firm* — Birch, Stewart, Kolasch & Birch, LLP

(57) ABSTRACT

A cell tray suitable for accommodating bottles of at least two different sizes. The cell tray has a loading surface to receive bottle bottoms in a matrix-like loading pattern and holding devices to receive and lock into place bottle mouths loaded onto a similar cell tray beneath said holding devices in a stack of cell trays. The holding devices are arranged as to align with at least two separate loading patterns on the loading surface. The first loading pattern is formed by a first plurality of holding devices arranged in a matrix-like formation having a first number of rows and columns. The second loading pattern is formed by a second plurality of holding devices arranged in a matrix-like formation having a second number of rows and columns. The second number of rows and columns is at least one less than the first number of rows and columns.

11 Claims, 7 Drawing Sheets

CELL TRAY

FIELD OF THE INVENTION

The present invention relates to logistics equipment. Particularly, the invention relates to cell trays used for transporting a plurality of bottles.

BACKGROUND ART

Cell trays are a commonly known medium for transporting and temporarily storing bottles. The majority of bottles transported on cell trays are bottles with a circular cross-section. Cell trays have traditionally been designed to accommodate a bottle of certain standardized size such as 0.5 or 1.5 liter. This creates a problem for not only logistics and warehousing but also production planning at beverage producers, for example, as the demand for a certain bottle size fluctuates. Accordingly, great stocks of cell trays suitable for a certain size of bottle need to be maintained, which absorbs capital and increases warehousing costs.

It is therefore an object of the present invention to provide a cell tray suitable for accommodating different sizes of bottles having circular cross-section. It is a particular aim to provide a cell tray suitable for accommodating circular cross-section having bottles of different proportions for adapting to diameter fluctuations of a given bottle volume between bottle standards in different market areas.

SUMMARY

The object of the invention is achieved with a novel cell tray for transporting a plurality of bottles. The cell tray comprises a quadrilateral base which has on one side a loading surface adapted to receive bottle bottoms in a matrix-like loading pattern. The cell tray also comprises holding devices provided to the base on the opposite side to the loading surface such that the holding devices are adapted to receive and lock into place bottle mouths of bottles loaded onto a similar cell tray beneath said holding devices in a stack of cell trays. The holding devices are arranged as to align with at least two separate loading patterns on the loading surface. The first loading pattern is formed by a first plurality of holding devices which are arranged in a matrix-like formation which consists of a first number of rows and of a first number of columns. The second loading pattern is formed by a second plurality of holding devices which is arranged in a matrix-like formation which consists of a second number of rows and of a second number of columns. The second number of rows is at least one less than the first number of rows, and the second number of columns is at least one less than the first number of columns. On the other side of the base the loading surface comprises protruding ridges which have a shape inverse to that of a combination of the first loading pattern of bottle bottoms having a circular profile with a radius and second loading pattern of bottle bottoms having a circular profile with a radius larger than that in the first loading pattern.

Considerable benefits are gained with aid of the present invention.

Because the tray is equipped with different size recesses, bottles of different sizes may be accommodated, which enables the use of only one standardized cell tray for at least two different packages. In addition to obvious benefits in reducing the variety of load carriers in logistics and warehousing, the cell tray according to the invention helps in supplying products regardless of fluctuations in demand regarding bottle size and shape since one cell tray may be used to carry large and small bottles. Particularly the protruding ridges on the loading surface of the base are shaped in an inverse manner to the loading patterns, whereby the ridges guide bottle bottoms having a radius smaller than that of the bottles on the first loading pattern, whereby the cell tray is able to accommodate bottles of three different sizes. This is particularly advantageous in beverage production facilities with automated handling equipment, wherein one type of cell tray is applicable to 1.5 liter bottles, for example, having the cross-sectional diameter of 95 mm or 90 mm depending on bottle standards as well as to larger bottles of 2 or 3 liter, for example.

BRIEF DESCRIPTION OF THE DRAWINGS

In the following certain embodiments of the invention are described in greater detail with reference to the accompanying drawings in which.

DETAILED DESCRIPTION OF CERTAIN EMBODIMENTS OF THE INVENTION

Figure 6A:
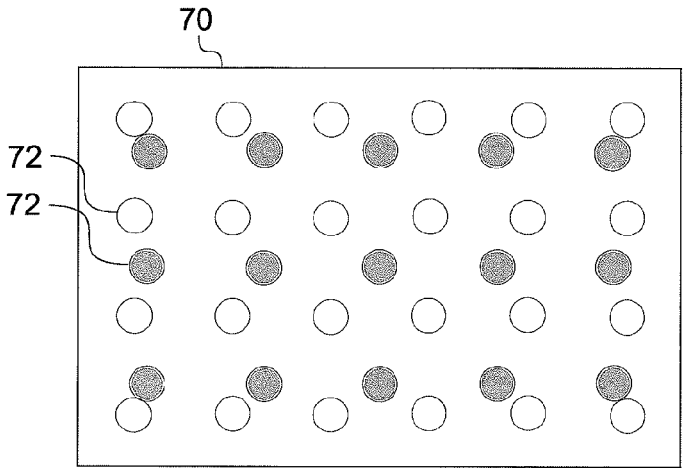
FIG. 6*a* presents a bottom elevation view of the cell tray of FIGS. 1 to 5 illustrating two pluralities of holding devices which form two corresponding matrix-like loading patterns $LP_1$ and $LP_2$.
Figure 6B:
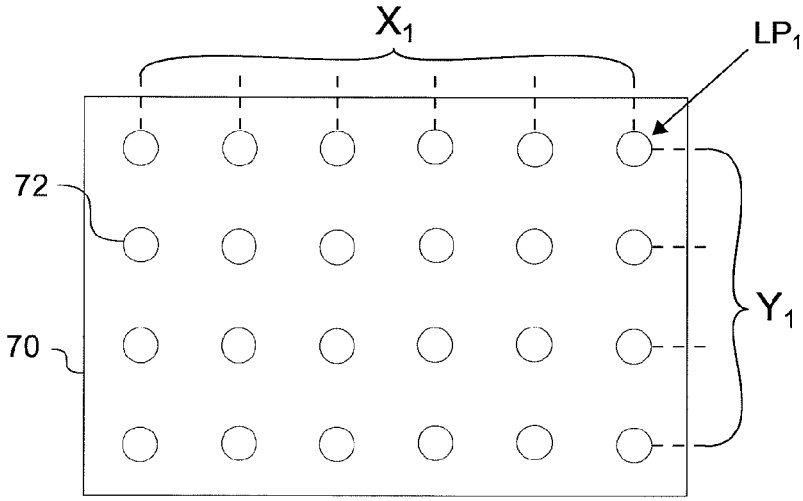
FIG. 6*b* presents the cell tray of FIG. 6*a* without the second plurality of holding devices, i.e. only the first loading pattern $LP_1$.
Figure 6C:
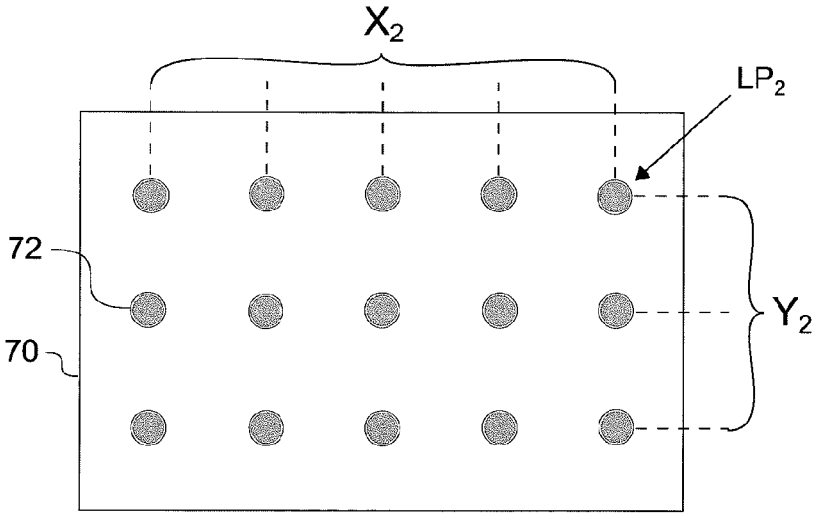
FIG. 6*c* presents the cell tray of FIG. 6*a* without the first plurality of holding devices, i.e. only the second loading pattern $LP_2$.
Figure 7:
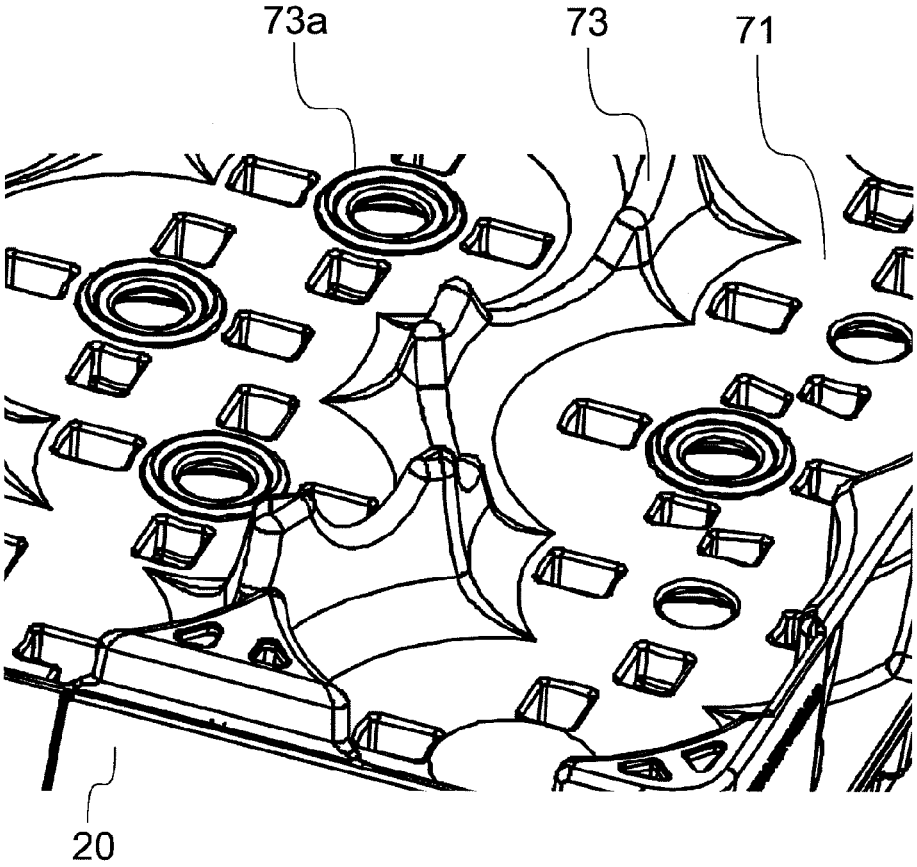
FIG. 7 presents a detail view of a group of protruding ridges of FIG. 5.

As can be seen from FIGS. 1 to 4, the cell tray 100 has a conventional basic structure featuring a quadrilateral base 70 which is surrounded by four lateral edges 10, 20, 30, 40 chained together for surrounding the base 70 such that the lateral edges 10, 20, 30, 40 provide lateral support for the contents of the cell tray 100 in all four lateral directions. In the figures the first and second lateral edge 10, 20 are arranged to oppose each other in parallel. The third and fourth edge lateral 30, 40 are arranged to oppose each other in parallel but orthogonally to the first and second lateral edge 10, 20, whereby a loading pattern may be formed between the lateral edges 10, 20, 30, 40 on the loading surface 71 of the base 70. Each lateral edge 10, 20, 30, 40 is provided with a plurality of subsequent primary recesses 50 which are adapted to receive the outer envelope surface of the bottle in an embedded manner. The primary recess 50 therefore has a radius $r_{50}$ which corresponds to that of the circular bottle profile A best seen in FIG. 3 in which the bottle profile A of first bottle type has been sketched with dashed line. In the illustrated example, the first and second lateral edges 10, 20 each have four subsequent primary recesses 50, whereas the third and fourth lateral edges 30, 40 have six resulting in a matrix-like first loading pattern ($LP_1$ in FIG. 6) of four by six. The cell tray 100 is therefore adapted to carry 24 bottles of a small diameter, such as 95 mm, for example.

Figure 1:
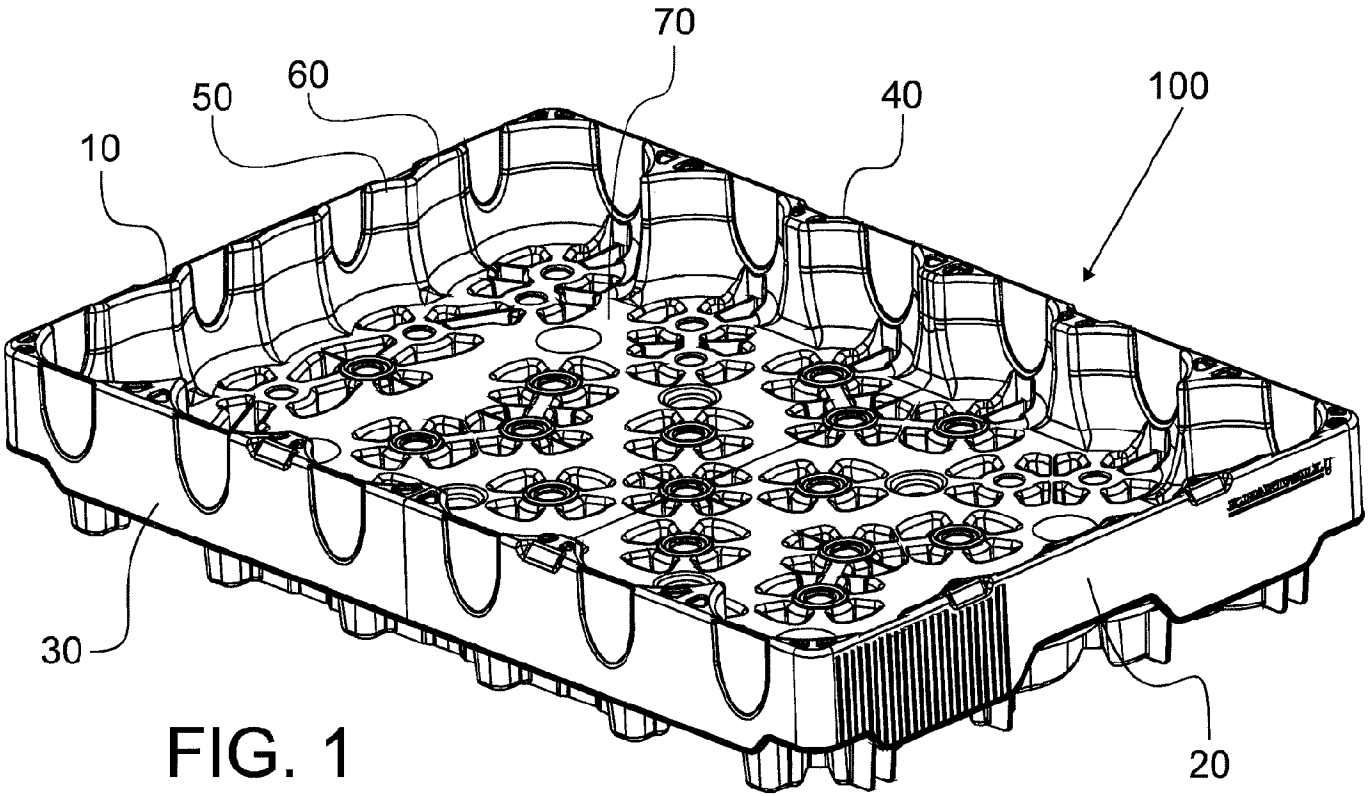
FIG. 1 presents an isometric view of a cell tray according to one embodiment without protruding ridges for improved legibility.
Figure 2:
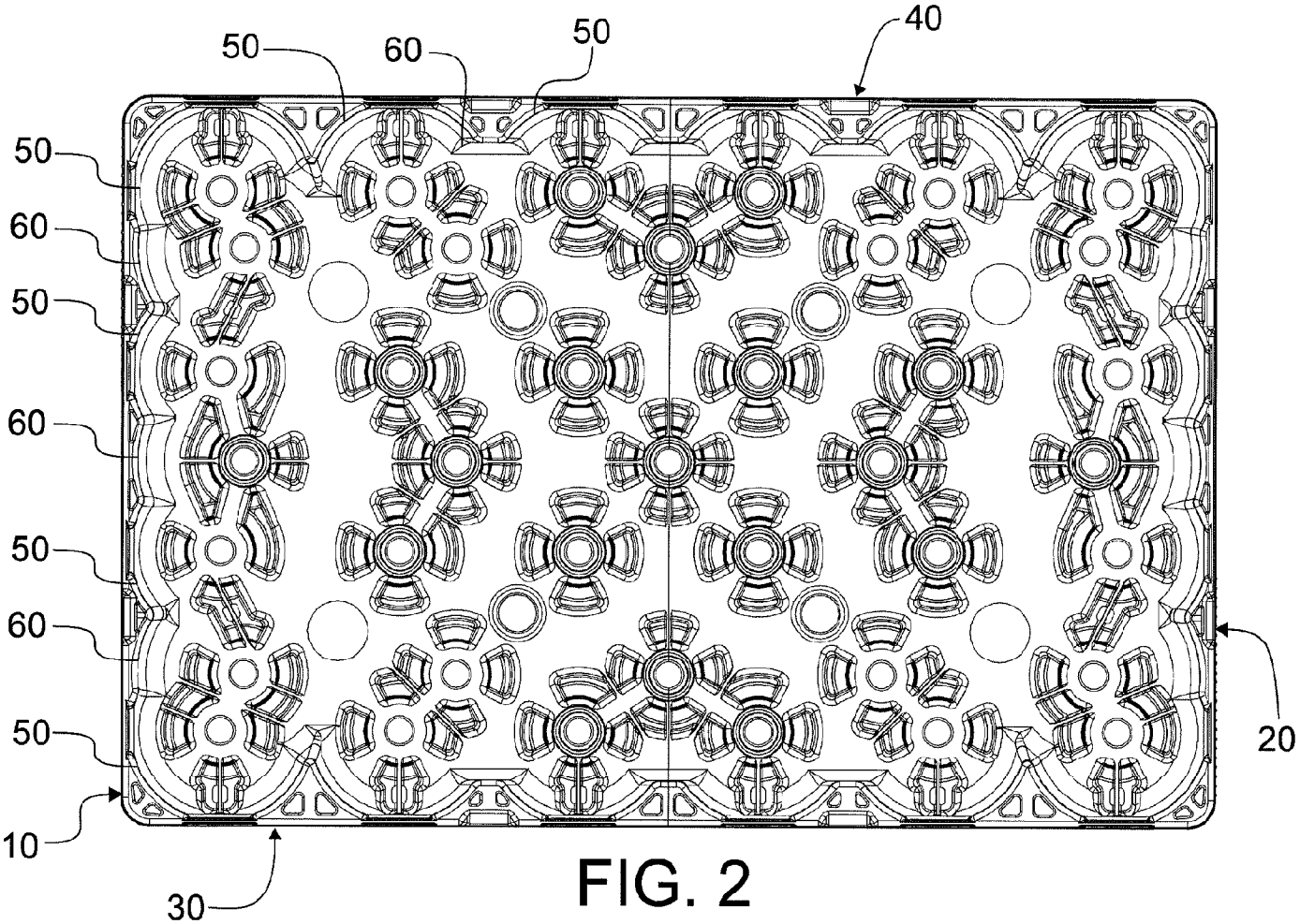
FIG. 2 presents a top elevation view of the cell tray according to FIG. 1.

As is also apparent from the figures, a plurality of subsequent secondary recesses 60 has been arranged to the same lateral edges 10, 20, 30, 40. Each secondary recess 60 is disposed between two subsequent primary recesses 50 such that the secondary recess 60 connects two subsequent primary recesses 50. FIG. 2 illustrates how the circumferential imaginary extensions of an adjacent primary and secondary recess 50, 60 intersect, wherein loading positions being defined by said circumferential imaginary extensions of adjacent primary and secondary recesses 50, 60 overlap. In other words, the secondary recesses 60 have been embedded between two primary recesses 50, whereby there is one less secondary recess 60 on each lateral edge 10, 20, 30, 40 leading to one less loading position per column and row in the matrix-like second loading pattern ($LP_2$ in FIG. 6) resulting from the secondary recesses 60. It is to be noted that the loading patterns $LP_1$, $LP_2$ co-exist on the same cell tray 100, i.e. the loading patterns $LP_1$, $LP_2$ are superposed in an embedded manner.

Figure 3:
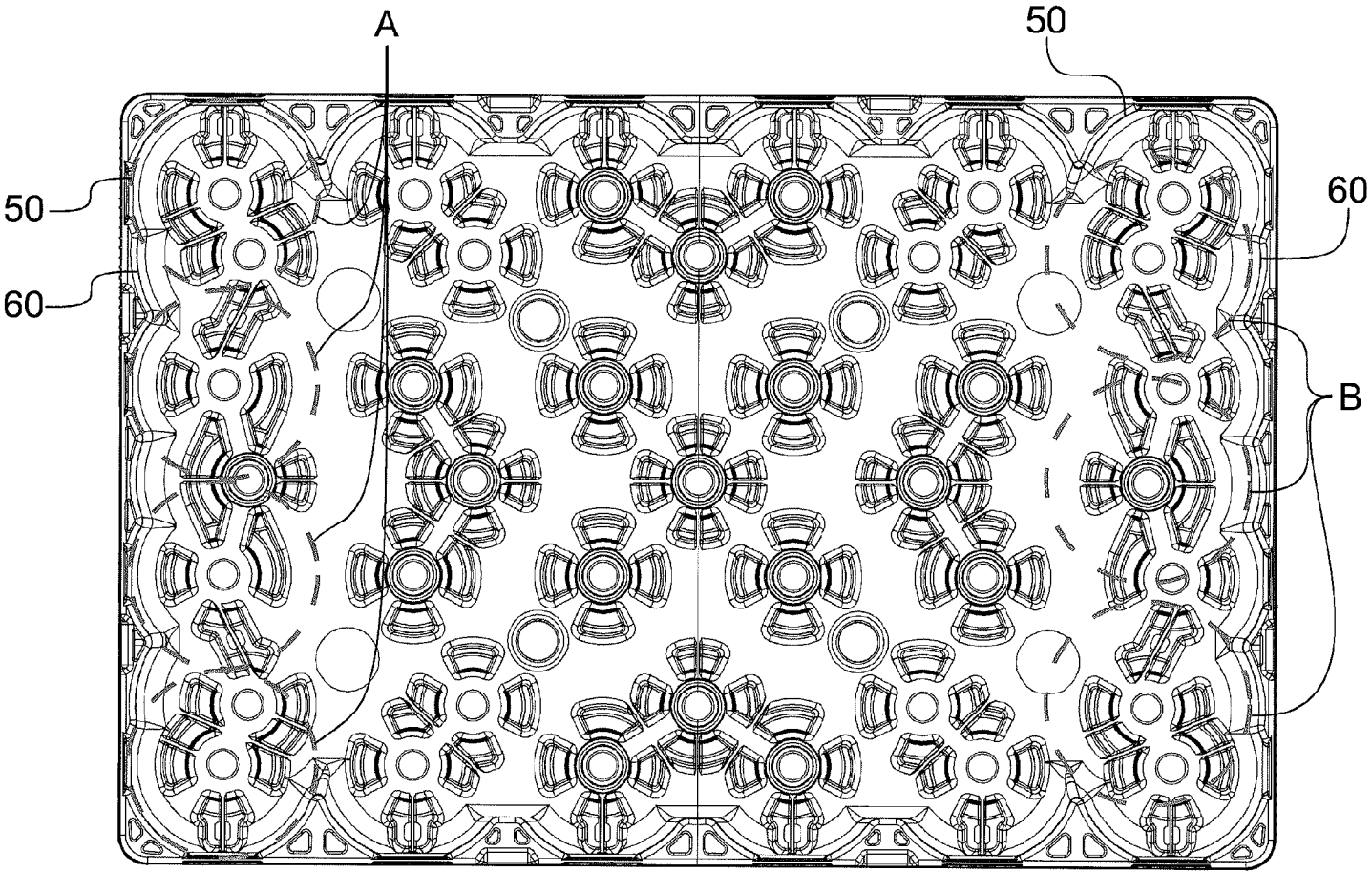
FIG. 3 presents the cell tray of FIG. 2 with sketches of two different bottle bottom profiles A, B arranged to loading positions at opposing ends of the cell tray.

What is also noticeable is that the radius $r_{60}$ of the secondary recess 60 is different to the radius $r_{50}$ of the primary recess 50. Particularly, the radius $r_{60}$ of the secondary recess 60 is larger than the radius $r_{50}$ of the primary recess 50. As best seen in FIG. 3, the radius $r_{60}$ of the secondary recess 60 corresponds to that of another bottle profile B which has a larger radius to the radius $r_{50}$ of the primary recess 50 and bottle profile A. In the illustrated example, the first and second lateral edges 10, 20 have been provided with three secondary recesses 60 which is naturally one less than the number of primary recesses 50 which the secondary recesses 60 connect. The third and fourth lateral edges 30, 40 have been provided with five secondary recesses 60 for the same reason. Accordingly, the matrix-like loading pattern formed by the secondary recesses 60 features 15 bottle positions arranged in a three by five matrix. In the given example, the diameter of the first bottle profile A corresponding to the primary recess 50 is 95 mm (1.5 liter) and the diameter of the second bottle profile B corresponding to the secondary recess 60 is 113 mm (2 to 3 liter).

Figure 4:
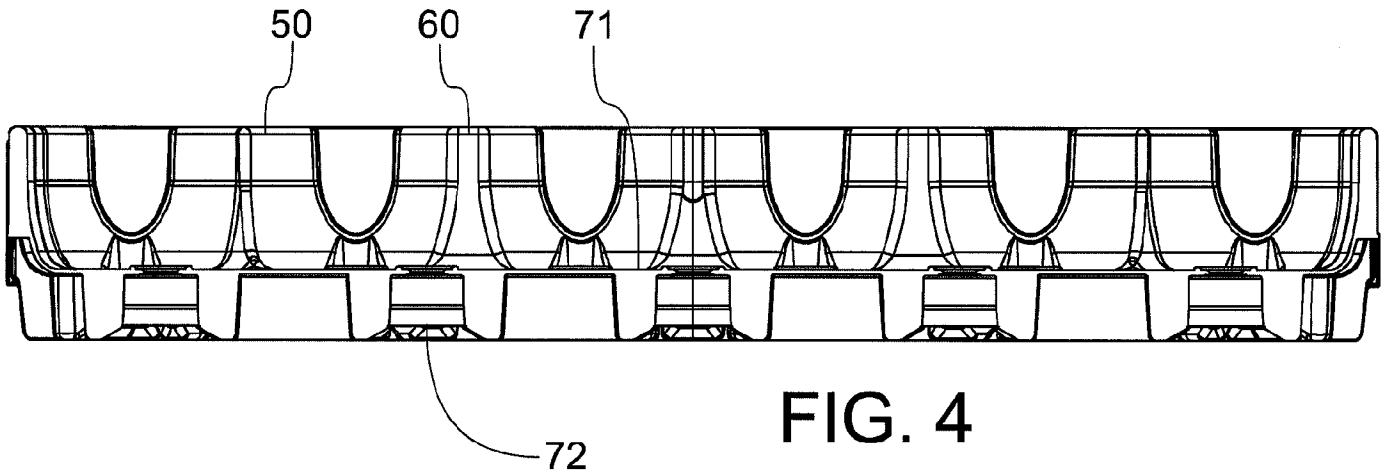
FIG. 4 presents a cross-sectional view along the center line of the cell tray of according to FIG. 1.

When loaded, the bottoms of the bottles are supported laterally by the lateral edges, 10, 20, 30, 40 such that the outer envelope surface of the bottles engage with the recesses 50, 60. In the embodiment of FIGS. 1 to 4, the loading surface 71 of the base is illustrated as being free of support members. On the opposing side to the loading surface 71, the base 70 comprises a plurality of holding devices 72 (FIG. 4). The holding devices 72 are adapted to receive and lock into place bottle mouths of bottles loaded onto a similar cell tray 100 beneath the holding devices 72, when loaded cell trays 100 are stacked on top of each other. The holding devices 72 are aligned with center points of the radii $r_{50}$, $r_{60}$ of each recess 50, 60. The holding devices 72 are thus arranged to correspond to both loading patterns $LP_1$, $LP_2$ on the bottom side of the cell tray 100.

Bottles with different the bottom profile radius typically have same size corks and bottle mouths, whereby the holding devices 72 may be similar under bottle positions being formed by primary and secondary recesses 50, 60 alike. Due to the size difference between the bottles to be received and therefore to the radii $r_{50}$, $r_{60}$ of the recesses 50, 60, the holding devices 72 are spaced from each other such that there is ample space for providing lateral support structures for the bottle mouths. As can be seen from FIGS. 2 and 3, adjacent bottle positions in alternative loading patterns are closer to each other farthest away from the center of the cell tray 100, whereby holding devices 72 on the peripheral area of the cell tray 100 may have to be partially merged.

In the illustrated examples, holding devices 72 are provided as locking sleeves which are known in the field per se. Alternatively, any suitable device known in the art for holding in place the mouth portion of a bottle is applicable, such as ribs arranged in a circle or a locking membrane with a center aperture. The shape of the holding devices 72 is therefore not be considered as limited to cylindrical but as any suitable shape for locking the top terminal end of the bottle.

Referring now back to the example given above, the first bottle profile A (Ø 95 mm) can be a typical 1.5 liter bottle and the second bottle profile B (Ø 113 mm) can be a typical 2 or 3 liter bottle. Thanks to the shape of the protruding ridges 73 and the cooperating arrangement of holding devices 72 on the opposite side of the cell tray 100, a third bottle profile has a diameter of 90 mm corresponding to an inner volume of 1.5 liter according to another standard may be loaded into the first loading pattern $LP_1$ instead of the original 95 mm corresponding to the same volume. In fact, 1.5 liter bottles, for example, may are produced globally with slightly different cross-sectional diameters depending on market areas. It is therefore advantageous that the protruding ridges—while not tightly laterally supporting the smaller 90 mm diameter bottle—yet prevent the third profile bottles from dislocating and guide the bottle mouths into the correct holding devices 72 provided on a similar cell tray 100 above in a stack of cell trays. Thus, a bottle of a diameter smaller than that of the first profile A may be loaded into the first loading pattern $LP_1$.

In another example (not shown) the diameter of the first bottle profile A corresponding to the primary recess 50 is 65 mm (0.33 to about 0.5 liter), which results in a matrix-like loading pattern of 54 bottle positions arranged in a six by nine matrix. In the same example, the diameter of the second bottle profile B corresponding to the secondary recess 60 is 95 mm (1.5 liter), which results in a matrix-like loading pattern of 24 bottle positions arranged in a four by six matrix. It is therefore to be noted, that the secondary recesses 60 need not connect two subsequent primary recesses 50. In fact in this embodiment, there are two fewer secondary recesses 60 than primary recesses 50 in the first and second lateral edge 10, 20 and three fewer secondary recesses 60 in the third and fourth lateral edge 30, 40. It is therefore to be concluded that the difference in the radii $r_{50}$, $r_{60}$ of the recesses 50, 60 and also of the bottle profiles A, B is to be selected according to the given bottle sizes such that the loading patterns match up. The dimensions of the lateral edges 10, 20, 30, 40 shall be selected accordingly.

Other arrangements are naturally also possible and considered to be obvious design alternatives for a skilled person now introduced to the novel cell tray concept according to the invention.

Figure 5:
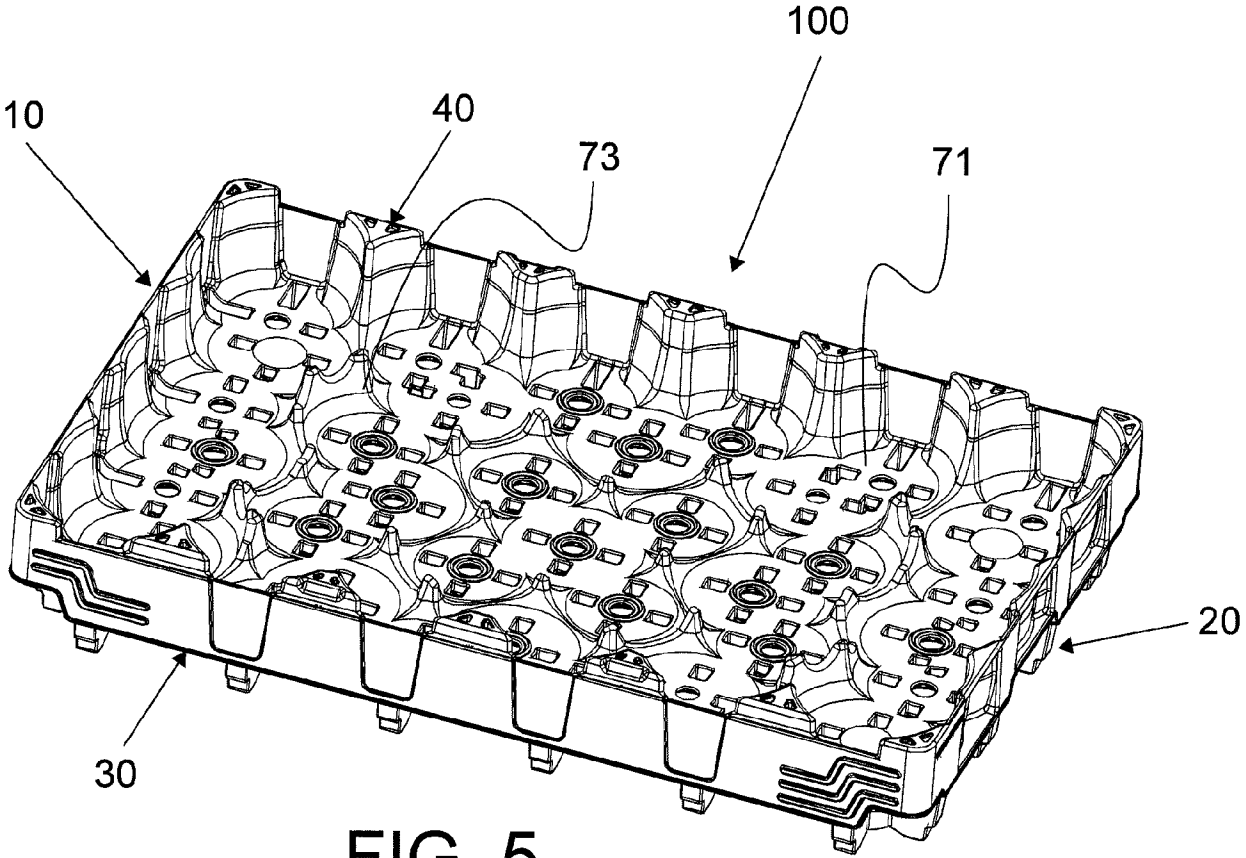
FIG. 5 presents an isometric view of a cell tray showing said protruding ridges.

According to one embodiment shown in FIG. 5, the loading surface 71 of the base 70 is not flat as in the embodiment of FIGS. 1 to 4, but comprises protruding ridges 73. Said ridges 73 are shaped to engage with bottle bottoms having a radius smaller than that of the primary recess 50, whereby the cell tray 100 is able to accommodate bottles of three different sizes. The ridges 73 are designed to surround the center points of the radius r50 of the primary recesses 50 for provide lateral support for bottles which have a cross-sectional radius smaller than that of the primary recess 50 and which are positioned into the primary recess 50.

The protruding ridges 73 comprise annular protrusions 73*a* on bottle positions in which the combination of the loading patterns $LP_1$, $LP_2$ permit. The annular protrusions 73*a* are shaped according to the base shape of the bottle helping the bottles to settle into position while being loaded into the loading pattern. Such annular protrusions 73*a* may result, e.g. from bottles with a pentalon shape.

In this context the term "comprise" is used to indicate inclusion instead of limitation, i.e. in addition to the stated elements, other elements may also be present. Furthermore, the above description is only to exemplify the invention and is not intended to limit the scope of protection defined by the claims. Indeed, it will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

Throughout this specification, unless the context requires otherwise, the word "comprise" or variations such as "comprises" or "comprising", will be understood to imply the inclusion of a stated integer or group of integers but not the exclusion of any other integer or group of integers.

TABLE 1

LIST OF REFERENCE NUMBERS.

| number | part |
|---|---|
| 10 | first edge |
| 20 | second edge |
| 30 | third edge |
| 40 | fourth edge |
| 50 | primary recess |
| 60 | secondary recess |
| 70 | base |
| 71 | loading surface |
| 72 | holding device |
| 73 | protruding ridge |
| 73a | annular protrusion |
| 100 | cell tray |
| A | bottle profile (fitting to primary recess) |
| B | bottle profile (fitting to secondary recess) |
| $r_{50}$ | radius of primary recess |
| $r_{60}$ | radius of secondary recess |
| $r_A$ | radius of the bottle profile A of the first loading pattern $LP_1$ |
| $r_B$ | radius of the bottle profile B of the second loading pattern $LP_2$ |
| LP1 | first loading pattern |
| LP2 | second loading pattern |

The invention claimed is:

1. Cell tray for transporting a plurality of bottles, the cell tray comprising:

a quadrilateral base which has on one side a loading surface which is configured to receive bottle bottoms in a matrix-like loading pattern, holding devices which are provided to the base on the opposite side to the loading surface, the holding devices being configured to receive and lock into place bottle mouths of bottles loaded onto a similar cell tray beneath said holding devices in a stack of cell trays, wherein:

the holding devices are arranged as to align with at least two separate loading patterns on the loading surface, wherein:

the first loading pattern is formed by a first plurality of holding devices arranged in a matrix-like formation consisting of a first number of rows and of a first number of columns, and wherein the second loading pattern is formed by a second plurality of holding devices arranged in a matrix-like formation consisting of a second number of rows and of a second number of columns, and wherein the second number of rows is at least one less than the first number of rows, and the second number of columns is at least one less than the first number of columns, and wherein the loading surface comprises protruding ridges having a shape inverse to that of a combination of:

the first loading pattern of bottle bottoms having a circular profile with a radius and second loading pattern of bottle bottoms having a circular profile with a radius larger than that in the first loading pattern.

2. Cell tray according to claim 1, wherein the cell tray further comprises:

four lateral edges being chained together for surrounding the loading surface such that the edges provide lateral support for the bottom of the bottle in all four lateral directions, a plurality of subsequent primary recesses arranged to the lateral edges and each adapted to receive the outer envelope surface of the bottle in an embedded manner, wherein the recesses radius corresponds to that of the circular bottle profile of the first loading pattern, and a plurality of subsequent secondary recesses arranged to the lateral edges, each secondary recess being arranged between two primary recesses of each lateral edge and having a radius corresponding to that of the circular bottle profile of the second loading pattern.

3. Cell tray according to claim 2, wherein the number of recesses in two mutually orthogonal edges define the number of loading positions on the tray, wherein the secondary recesses yield at least one fewer loading positions per column and row than the primary recesses in said loading pattern.

4. Cell tray according to claim 2, wherein a secondary recess connects two subsequent primary recesses.

5. Cell tray according to claim 4, wherein circumferential imaginary extensions of an adjacent primary and secondary recess intersect, wherein loading positions defined by said circumferential imaginary extensions of adjacent primary and secondary recesses overlap.

6. Cell tray according to claim 1, wherein the protruding ridges which are shaped to guide into the loading position bottle bottoms having a radius smaller than that of the primary recess, whereby the cell tray is able to accommodate bottles of three different sizes.

7. Cell tray according to claim 6, wherein the ridges surround the center points of the radius of the primary recesses such that the ridges provide lateral support for bottles having cross-sectional radius smaller than that of the primary recess and being positioned into the primary recess.

8. Cell tray according to claim 1, wherein the holding devices are aligned with center points of the radii of each recess.

9. Cell tray according to claim 1, wherein the plurality of protruding ridges comprise annular protrusions aligned with the holding devices on the opposite side of the base for guiding into place bottle bottoms.

10. Cell tray according to claim 3, wherein a secondary recess connects two subsequent primary recesses.

11. Cell tray according to claim 10, wherein circumferential imaginary extensions of an adjacent primary and secondary recess intersect, wherein loading positions defined by said circumferential imaginary extensions of adjacent primary and secondary recesses overlap.

* * * * *